US008342214B2

(12) United States Patent
Rousseau

(10) Patent No.: US 8,342,214 B2
(45) Date of Patent: Jan. 1, 2013

(54) RESERVOIR ASSEMBLY INCLUDING NESTED RESERVOIRS

(76) Inventor: Normand Rousseau, Quebec (CA)

( * ) Notice: Subject to any disclaimer, the term of this patent is extended or adjusted under 35 U.S.C. 154(b) by 954 days.

(21) Appl. No.: 12/377,953

(22) PCT Filed: Aug. 22, 2007

(86) PCT No.: PCT/CA2007/001440

§ 371 (c)(1),
(2), (4) Date: Feb. 18, 2009

(87) PCT Pub. No.: WO2008/022440

PCT Pub. Date: Feb. 28, 2008

(65) Prior Publication Data

US 2010/0230418 A1 Sep. 16, 2010

(30) Foreign Application Priority Data

Aug. 22, 2006 (GB) ..... 0616605.2

(51) Int. Cl.
*B65D 90/02* (2006.01)

(52) U.S. Cl. ..... 141/85; 141/1; 141/45; 141/374; 220/731

(58) Field of Classification Search ..... 141/1, 44–45, 141/85, 374; 220/731
See application file for complete search history.

(56) References Cited

U.S. PATENT DOCUMENTS 2,520,883 A * 8/1950 Kornemann et al. .... 220/560.05
3,431,396 A * 3/1969 Kodaira ..... 219/401
3,598,178 A * 8/1971 Staub ..... 165/104.26
3,748,865 A * 7/1973 Laverman et al. ..... 62/48.3
4,010,779 A * 3/1977 Pollock et al. ..... 141/44
4,519,415 A * 5/1985 Carn ..... 137/318
4,840,283 A * 6/1989 Lillywhite et al. ..... 220/565
4,971,214 A 11/1990 Lillywhite et al.
5,201,435 A 4/1993 Harding et al.
5,398,841 A * 3/1995 Harding ..... 220/565
5,421,478 A * 6/1995 Lovato ..... 220/565
5,435,020 A * 7/1995 Maskell et al. ..... 4/524
5,570,805 A 11/1996 Harding

FOREIGN PATENT DOCUMENTS

JP 2003307108 A 10/2003

OTHER PUBLICATIONS

International Search Report for PCT/CA2007/001440.

* cited by examiner

*Primary Examiner* — Gregory Huson
*Assistant Examiner* — Nicolas A Arnett

(57) ABSTRACT

A reservoir assembly for containing a non-corrosive liquid and a gas containing an evaporated liquid. The reservoir assembly includes a main reservoir having a main reservoir bottom wall, a main reservoir top wall and a main reservoir peripheral wall extending therebetween. An auxiliary reservoir, is provided having an auxiliary reservoir bottom wall and an auxiliary reservoir peripheral wall extending therefrom defining a peripheral wall top edge. The auxiliary reservoir located inside the main reservoir with the auxiliary reservoir peripheral wall adjacent the main reservoir peripheral wall to allow an infiltration of the non-corrosive liquid therebetween when the auxiliary reservoir is filled and the non-corrosive liquid overflows over the peripheral wall top edge. A deflector, is mounted inside the main reservoir to the main reservoir peripheral wall, having a deflector free end located above the auxiliary reservoir.

17 Claims, 2 Drawing Sheets

RESERVOIR ASSEMBLY INCLUDING NESTED RESERVOIRS

FIELD OF THE INVENTION

The present invention relates to the general field of liquid storage and is more particularly concerned with a reservoir assembly.

BACKGROUND OF THE INVENTION

Rust formation occurring inside the bottom portion of metallic reservoirs, such as the very common fuel oil tanks for domestic applications, is well documented in the art. Such rust formation generally involves air moisture inside the reservoir that condenses on the relatively colder inside walls of the reservoir, dribbles down along the sidewalls and, finally, accumulates in the bottom portion of the metallic reservoir or tank. With time, prolonged contact between the accumulated water and the metallic surfaces of the reservoir causes rust formation, particularly around the couplings and joints that are usually found in bottom portion of the latter. Furthermore, other factors contribute to the acceleration of rust formation, such as for example, the presence of traces or chlorides or bacterial contamination in the accumulated water, as well as the presence of sulphur-containing chemicals in the fuel oil which, when mixed with water, forms an acid.

Reservoirs made of metals such as, for example, steel or iron, that include protection against internal rust formation are known in the art. These reservoirs of the prior art generally propose a metallic reservoir having an internal rust-proof coating or internal structure, or a combination of these, which inhibits or at least slows down rust formation on the inside walls of the reservoir.

The prior art internal surface coatings or treatment of the metallic reservoirs generally consist of an epoxy, a ceramic or an electroplated metal.

The prior art internal structures, such as water traps, are generally designed to capture and retain the accumulating water in a specific compartment or recess embedded in the bottom portion of the metallic reservoir. The structure or recess is generally coupled to a drainage outlet through which the accumulated water can be evacuated periodically or on a continuous basis.

While the metallic reservoirs of the prior art, when equipped with an internal rust protection coating or structure, generally fulfill the main objective of storing petroleum products in economical metallic reservoirs, they also have numerous disadvantages.

For example, the metallic surface coating or treatment generally requires a special preparation of the metal surfaces inside the reservoir prior to application of the rust inhibiting treatment or coating. The surface preparation usually consists in sandblasting the metal surfaces, a hard to control operation. Inappropriate preparation can have long-term repercussions on the effectiveness of the surface coating or treatment against rust formation. Furthermore, the preparation of the metal surfaces, as well as the application of the final metal surface treatment or coating, generally requires expensive equipments operated in humidity controlled environments, followed by thorough quality control tests, all of which add up to the complexity of assembly and production cost of the finished reservoir.

Additionally, internal structures comprising a water trap, such as a compartment or a recess integrated in the bottom portion of the reservoir, generally keep the accumulating water in relatively prolonged contact with the inner metallic walls of the latter when the water is not evacuated on a regular basis. Thus, the internal structures only have a limited effectiveness against internal rust formation in the reservoir.

Accordingly, there exists a need for an improved reservoir. It is a general object of the present invention to provide such a reservoir.

SUMMARY OF THE INVENTION

In a first broad aspect, the invention provides a reservoir assembly for containing a non-corrosive liquid and a gas located above the non-corrosive liquid, the gas containing an evaporated liquid, the reservoir assembly comprising:

a main reservoir, the main reservoir defining a main reservoir bottom wall, a main reservoir top wall and a main reservoir peripheral wall extending therebetween;

an auxiliary reservoir, the auxiliary reservoir defining an auxiliary reservoir bottom wall and an auxiliary reservoir peripheral wall extending therefrom, the auxiliary reservoir peripheral wall defining a peripheral wall top edge, the auxiliary reservoir being located inside the main reservoir with the auxiliary reservoir peripheral wall located substantially adjacent the main reservoir peripheral wall so as to allow an infiltration of the non-corrosive liquid between the main reservoir peripheral wall and the auxiliary reservoir peripheral wall when the auxiliary reservoir is filled with the non-corrosive liquid and the non-corrosive liquid overflows over the peripheral wall top edge; and a deflector, the deflector defining a deflector free end, the deflector being mounted inside the main reservoir to the main reservoir peripheral wall, the deflector free end being located above the auxiliary reservoir;

whereby, when the evaporated liquid condenses from the gas onto the main reservoir peripheral wall above the deflector to form a condensed liquid and the condensed liquid flows downwardly under the action of gravity, the deflector deflects the condensed liquid towards the auxiliary reservoir.

The proposed reservoir assembly takes advantage of the non-corrosive properties of a liquid to store, such as a petroleum product, as a protection against rust formation by avoiding prolonged contact between a corrosive liquid, such as condensed water, and the walls of the main reservoir.

The proposed reservoir assembly is typically manufacturable relatively simply and economically. Furthermore, the proposed reservoir is usable similarly to conventional reservoirs.

In another broad aspect, the invention provides a method for reducing the risks of corrosion in a reservoir assembly fillable with a non-corrosive liquid and a gas located above the non-corrosive liquid, the gas containing an evaporated liquid, the reservoir assembly including a main reservoir, an auxiliary reservoir located inside the main reservoir and a deflector, the deflector defining a deflector free end, the deflector being mounted inside the main reservoir above the auxiliary reservoir with the deflector free end overhanging the auxiliary reservoir, the method comprising:

filling the auxiliary reservoir with the non-corrosive liquid until the non-corrosive liquid overflows from the auxiliary reservoir; and infiltrating the non-corrosive liquid between the main reservoir and the auxiliary reservoir with the non-corrosive liquid overflowing from the auxiliary reservoir.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings, in which.

DETAILED DESCRIPTION

Figure 1:
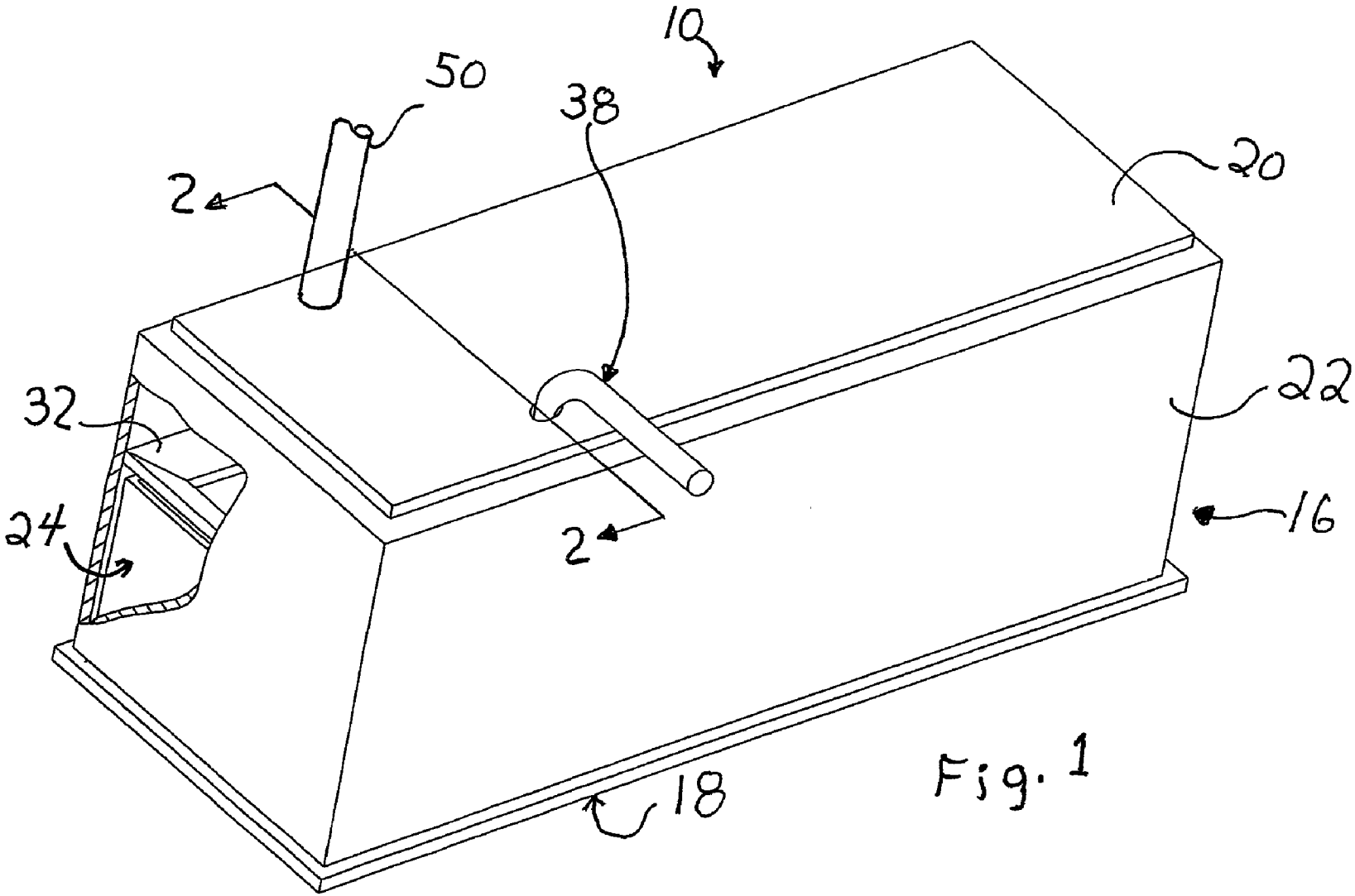
FIG. 1, in a top perspective partial view, illustrates a reservoir assembly in accordance with an embodiment of the present invention.
Figure 2:
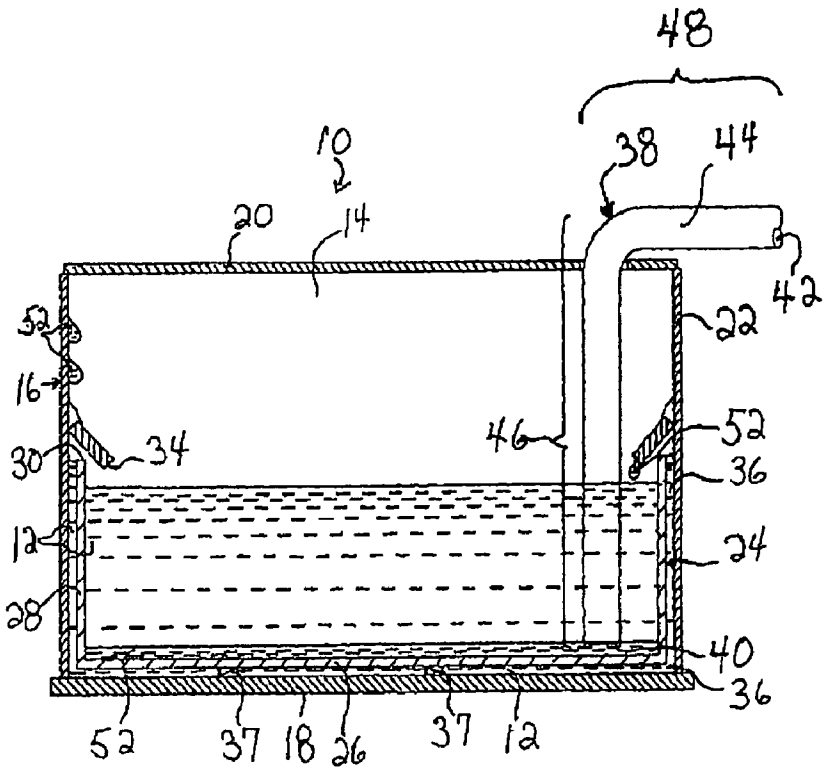
FIG. 2, in a side cross-sectional view taken along the line 2-2 of FIG. 1, illustrates the reservoir assembly shown in FIG. 1.

FIGS. 1 and 2 illustrate a reservoir assembly 10. As better seen in FIG. 2, the reservoir assembly 10 is usable for containing a non-corrosive liquid 12 and a gas 14 located above the non-corrosive liquid 12. The gas 14 contains an evaporated liquid. For example, the evaporated liquid is a corrosive liquid that is potentially damaging to some portions of the reservoir assembly 10. In a specific embodiment of the invention, the non-corrosive liquid 12 is a petroleum product, such as heating oil, and the gas 14 is air containing an evaporated gas in the form of water vapour.

The reservoir assembly 10 includes a main reservoir 16. The main reservoir 16 defines a main reservoir bottom wall 18, a main reservoir top wall 20 and a main reservoir peripheral wall 22 extending therebetween. In some embodiments of the invention, the main reservoir top wall 20 is a lid removably mountable to the main reservoir peripheral wall 22. However, it is within the scope of the invention to include any other suitable main reservoir top wall 20 in the reservoir assembly 10.

The reservoir assembly 10 also includes an auxiliary reservoir 24. The auxiliary reservoir 24 defines an auxiliary reservoir bottom wall 26 and an auxiliary reservoir peripheral 28 extending therefrom. The auxiliary reservoir peripheral wall 28 defines a peripheral wall top edge 30. The auxiliary reservoir 24 is located inside the main reservoir 16 with the auxiliary reservoir peripheral wall 28 located substantially adjacent the main reservoir peripheral wall 22 so as to allow an infiltration of the non-corrosive liquid 12 between the main reservoir peripheral wall 22 and the auxiliary reservoir peripheral wall 28 when the auxiliary reservoir 24 is filled with the non-corrosive liquid 12 and the non-corrosive liquid 12 overflows over the peripheral wall top edge 30.

A deflector 32 defining a deflector free end 34 is mounted inside the main reservoir 16 to the main reservoir peripheral wall 22. Typically, the deflector 32 is located substantially adjacent the peripheral wall top edge 30. The deflector free end 34 is located above the auxiliary reservoir 24. In other words, the deflector 32 is mounted inside the main reservoir 16 above the auxiliary reservoir 24 with the deflector free end 34 overhanging the auxiliary reservoir 24. When the evaporated liquid condenses from the gas 14 onto the main reservoir peripheral wall 22 above the deflector 32 to form a condensed liquid 52, the condensed liquid 52 flows downwardly under the action of gravity. The deflector 32 deflects the condensed liquid 52 towards the auxiliary reservoir 24. Typically, the condensed liquid 52 has a greater density than the non-corrosive liquid 12 and accumulates at the bottom of the auxiliary reservoir 24.

In some embodiments of the invention, as shown in FIG. 2, the auxiliary reservoir 24 is mounted inside the main reservoir 16 so as to further allow an infiltration of the non-corrosive liquid 12 between the main reservoir bottom wall 18 and the auxiliary reservoir bottom wall 26 when the auxiliary reservoir 24 is filled with a non-corrosive liquid 12 and the non-corrosive liquid 12 overflows over the peripheral wall top edge 30.

In some embodiments of the invention, the auxiliary reservoir peripheral wall 28 is substantially spaced apart from the main reservoir peripheral wall 22 for creating a main reservoir-to-auxiliary reservoir spacing 36 therebetween. For example, the main reservoir-to-auxiliary reservoir spacing 36 is between 1 and 5 cm wide, these dimensions having proved to be optimal in many applications, such as in the domestic storage of heating oil. Furthermore, the reservoir assembly 10 also includes auxiliary reservoir supports 37, two of which being shown in FIG. 2, supporting the auxiliary reservoir bottom wall 26 spaced-apart from the main reservoir bottom wall 18.

However, in alternative embodiments of the invention, there is no permanent main reservoir-to-auxiliary reservoir spacing 36 and the infiltration of the non-corrosive liquid 14 occurs in any other manner. For example, this infiltration is performed through a capillarity effect, among other possibilities. Also, it is within the scope of the invention to have reservoir assemblies similar to the reservoir assembly 10 in which the auxiliary reservoir bottom wall 26 abuts against the main reservoir bottom 18.

Typically, the auxiliary reservoir 24 is substantially rust-proof. A manner of achieving this rust-proofing is to have an auxiliary reservoir 24 that is made out of a material that is substantially rust-proof such as, for example, stainless steel, a polymer, polyvinyl chloride (PVC), Teflon™ or fibreglass, among other possibilities. However, in other embodiments of the invention, the auxiliary reservoir 24 is rust-proofed by being coated with any suitable rust-proof material. An advantage of having the auxiliary reservoir 24 made out entirely of a rust-proof material includes that the auxiliary reservoir 24 is thereby unlikely to be damaged by the condensed liquid 52 in cases where the condensed liquid 52 is corrosive.

Typically, the main reservoir 16 is made out of a metal such as steel. Having the main reservoir 16 made out of a metal allows manufacturing of a relatively solid reservoir 16 at relatively low costs.

In some embodiments of the invention, the main and auxiliary reservoirs 16 and 24 have respectively a main reservoir overall height and an auxiliary reservoir overall height. It has been found that having an auxiliary reservoir overall height of from about 5 percent to about 35 percent of the main reservoir overall height is particularly advantageous in many industries, such as for example in domestic heating oil storage. Indeed, since the auxiliary reservoir 16 is relatively expensive if built using typical rust-proof materials, it is advantageous to have an auxiliary reservoir 16 having a relatively small height.

The deflector 32 is secured to the peripheral wall 16 in any suitable manner. For example, the deflector 32 is sealingly cemented to the main reservoir peripheral wall 22. In other embodiments of the invention, the deflector 32 extends integrally from the main reservoir peripheral wall 22 or is welded to the main reservoir peripheral wall 22.

To guide the condensed liquid 52 towards the auxiliary reservoir 24, the deflector 32 is angled with the vertical. It has been found that having a deflector making an angle of about 45 degrees with the vertical provides optimal characteristics as it allows manufacturing a relatively compact reservoir assembly 10 while guiding the condensed liquid 52 towards the auxiliary reservoir 24 rapidly enough that the condensed liquid does not evaporate back into the gas 14.

The reservoir assembly 10 further includes an evacuation tube 38. The evacuation tube 38 defines a tube inlet 40, a tube outlet 42 and a tube passageway 44 extending therebetween. The tube inlet 40 is located substantially adjacent the auxiliary reservoir bottom wall 26 and the tube outlet 42 is located outside of the main reservoir 10. For example, the evacuation tube 38 extends through the main reservoir top wall 20.

For example, the evacuation tube 38 is substantially L-shaped and includes an evacuation tube first section 46 and an evacuation tube second section 48 extending from the evacuation tube first section, the evacuation tube second section 48 being angled relatively to the evacuation tube first section 46. The evacuation tube first section 46 extends through the main reservoir top wall 20.

The evacuation tube second section 48 is typically substantially perpendicular to the evacuation tube first section 46. This reduces the risks of an intended user dropping objects unintentionally into the reservoir assembly 10 when using the evacuation tube 38 to remove the condensed liquid 52 accumulating at the bottom of the auxiliary reservoir 24.

In some embodiments of the invention, the reservoir assembly 10 is vented by a conventional vent 50, seen in FIG. 1. The vent 50 allows a gas present in the environment in which the reservoir assembly 10 is used, for example air, to enter into and exit from the main reservoir 16 as the level of the non-corrosive liquid 12 varies inside the reservoir assembly 10.

In use, the reservoir assembly 10 is first filled with the non-corrosive liquid 12 until the non-corrosive liquid 12 overflows from the auxiliary reservoir 24 into the main reservoir-to-auxiliary reservoir spacing 36. The non-corrosive liquid 12 then infiltrates between the main reservoir 16 and the auxiliary reservoir 24.

Subsequently, due for example to temperature variations, the main reservoir peripheral wall 22 reaches a temperature such that the gas 14 present above the non-corrosive liquid 12 reaches the condensation temperature for the evaporated liquid. This causes the evaporated liquid to condense on the main reservoir peripheral wall 22 above the deflector 30 to form a condensed liquid 52. The condensed liquid 52 is then guided downwardly along the main reservoir peripheral wall 22 and down the deflector 32 until reaching the deflector free end 34. The deflector 32 therefore guides the condensed liquid 52 into the auxiliary reservoir 24 as the condensed liquid 52, after reaching the deflector free 34, falls into the auxiliary reservoir 24.

Occasionally, or continuously, the condensed liquid 52 accumulated at the bottom of the auxiliary reservoir 24 is removed from the auxiliary reservoir 24 using the evacuation tube 38. For example, this is performed by siphoning or pumping the condensed liquid 52 through the evacuation tube 38.

The non-corrosive liquid 12 present inside the main reservoir-to-auxilliary reservoir spacing 36 prevents the gas 14 from reaching this main reservoir-to-auxiliary reservoir spacing 36 and, therefore, prevents condensation of the evaporated liquid thereinto. The main reservoir 16 is thus protected from the corrosive action of the evaporated liquid by the non-corrosive liquid 12.

Figure 3:
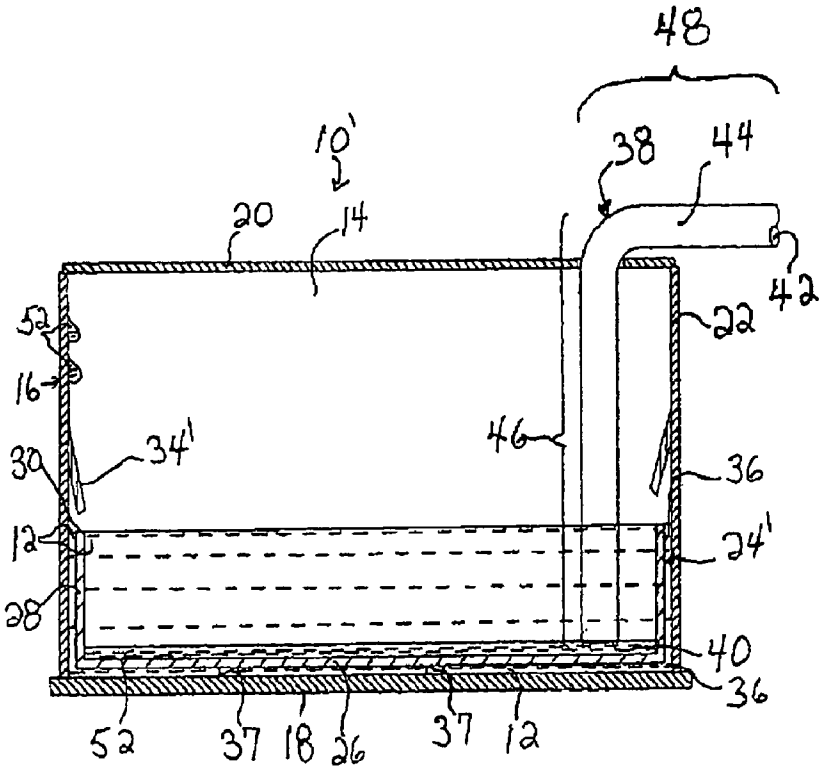
FIG. 3, in a side cross-sectional, illustrates a reservoir assembly in accordance with an alternative embodiment of the present invention.

FIG. 3 illustrates a reservoir assembly 10' in accordance with an alternative specific embodiment of the invention. In the reservoir assembly 10', the auxiliary reservoir 24' has an overall height of about 35 percent of the main reservoir overall height and the deflector 34' extends substantially downwardly. Otherwise, the reservoir assemblies 10' and 10 function in a similar manner and have similar structures.

The reader skilled in the art will appreciate that the general size and shape of the main and auxiliary reservoirs 16 and 24 depend on the specific application envisioned, and is therefore not limited to the size and shape illustrated in the drawings.

Also, the evacuation tube 38 can have any other configuration and can extend through any suitable wall of the main reservoir 16. In yet other embodiments of the invention, the evacuation tube 38 is replaced by a drainage hole (not shown in the drawings).

Although the present invention has been described hereinabove by way of preferred embodiments thereof, it can be modified, without departing from the spirit and nature of the subject invention as defined in the appended claims.

What is claimed is:

1. A reservoir assembly for containing a non-corrosive liquid and a gas located above said non-corrosive liquid, said gas containing an evaporated liquid, said reservoir assembly comprising:

a main reservoir, said main reservoir defining a main reservoir bottom wall, a main reservoir top wall and a main reservoir peripheral wall extending therebetween;

an auxiliary reservoir, said auxiliary reservoir defining an auxiliary reservoir bottom wall and an auxiliary reservoir peripheral wall extending therefrom, said auxiliary reservoir peripheral wall defining a peripheral wall top edge, said auxiliary reservoir being located inside said main reservoir with said auxiliary reservoir peripheral wall located substantially adjacent said main reservoir peripheral wall so as to allow an infiltration of said non-corrosive liquid between said main reservoir peripheral wall and said auxiliary reservoir peripheral wall when said auxiliary reservoir is filled with said non-corrosive liquid and said non-corrosive liquid overflows over said peripheral wall top edge; and a deflector, said deflector defining a deflector free end, said deflector being mounted inside said main reservoir to said main reservoir peripheral wall, said deflector free end being located above said auxiliary reservoir;

whereby, when said evaporated liquid condenses from said gas onto said main reservoir peripheral wall above said deflector to form a condensed liquid and said condensed liquid flows downwardly under the action of gravity, said deflector deflects said condensed liquid towards said auxiliary reservoir to collect said condensed liquid therein.

2. A reservoir assembly as defined in claim 1, wherein said auxiliary reservoir is mounted inside said main reservoir so as to allow an infiltration of said non-corrosive liquid between said main reservoir bottom wall and said auxiliary reservoir bottom wall when said auxiliary reservoir is filled with said non-corrosive liquid and said non-corrosive liquid overflows over said peripheral wall top edge.

3. A reservoir assembly as defined in claim 2, further comprising an auxiliary reservoir support, said auxiliary reservoir support supporting said auxiliary reservoir bottom wall spaced apart from said main reservoir bottom wall.

4. A reservoir assembly as defined in claim 1, wherein said auxiliary reservoir peripheral wall is substantially spaced apart from said main reservoir peripheral wall for creating a main reservoir-to-auxiliary reservoir spacing therebetween.

5. A reservoir assembly as defined in claim 1, wherein said auxiliary reservoir is substantially rust-proof.

6. A reservoir assembly as defined in claim 5, wherein said auxiliary reservoir is made out of a material selected from the group consisting of: stainless steel, a polymer, polyvinyl chloride (PVC), polytetrafluoroethylene and fibreglass.

7. A reservoir assembly as defined in claim 1, wherein said main reservoir is made out of a metal.

8. A reservoir assembly as defined in claim 1, wherein said main and auxiliary reservoirs have respectively a main reservoir overall height and an auxiliary reservoir overall height, said auxiliary reservoir overall height being from about 5 percent to about 35 percent of said main reservoir overall height.

9. A reservoir assembly as defined in claim 1, wherein said deflector is sealingly cemented to said main reservoir peripheral wall.

10. A reservoir assembly as defined in claim 1, wherein said deflector is angled with the vertical at an angle of about 45 degrees.

11. A reservoir assembly as defined in claim 1, further comprising an evacuation tube, said evacuation tube defining a tube inlet, a tube outlet and a tube passageway extending therebetween, said tube inlet being located substantially adjacent said auxiliary reservoir bottom wall and said tube outlet being located outside of said main reservoir.

12. A reservoir assembly as defined in claim 11, wherein said evacuation tube extends through said main reservoir top wall.

13. A reservoir assembly as defined in claim 12, wherein said evacuation tube includes an evacuation tube first section and an evacuation tube second section extending from said evacuation tube first section, said evacuation tube second section being angled relatively to said evacuation tube first section, said evacuation tube first section extending through said main reservoir top wall.

14. A reservoir assembly as defined in claim 13, wherein said evacuation tube second section is substantially perpendicular to said evacuation tube first section.

15. A method for reducing the risks of corrosion in a reservoir assembly fillable with a non-corrosive liquid and a gas located above said non-corrosive liquid, said gas containing an evaporated liquid, said reservoir assembly including a main reservoir, an auxiliary reservoir located inside said main reservoir and a deflector, said deflector defining a deflector free end, said deflector being mounted inside said main reservoir above said auxiliary reservoir with said deflector free end overhanging said auxiliary reservoir, said method comprising:

filling said auxiliary reservoir with said non-corrosive liquid until said non-corrosive liquid overflows from said auxiliary reservoir; and infiltrating said non-corrosive liquid between said main reservoir and said auxiliary reservoir with said non-corrosive liquid overflowing from said auxiliary reservoir.

16. A method as defined in claim 15, wherein said evaporated liquid condenses on said main reservoir peripheral wall above said deflector to form a condensed liquid, said method further comprising guiding said condensed liquid into said auxiliary reservoir using said deflector.

17. A method as defined in claim 16, further comprising removing from said auxiliary reservoir at least a portion of said condensed liquid.

* * * * *